US005203131A

United States Patent [19]

Adlam

[11] Patent Number: 5,203,131

[45] Date of Patent: Apr. 20, 1993

[54] STRUCTURES

[75] Inventor: Francis C. Adlam, Bury, England

[73] Assignee: Alifabs Limited, Surrey, United Kingdom

[21] Appl. No.: 693,458

[22] Filed: Apr. 29, 1991

[51] Int. Cl.[5] ..... E04B 1/34

[52] U.S. Cl. ..... 52/236.1; 52/81; 52/82; 52/235

[58] Field of Search ..... 52/206, 79.1–79.14, 52/236.1–236.9, 80, 81, 82, 73, 235

[56] References Cited

U.S. PATENT DOCUMENTS 3,562,974 2/1971 Niemeyer ..... 52/236.1 X

*Primary Examiner*—Richard E. Chilcot, Jr

*Attorney, Agent, or Firm*—Wenderoth, Lind & Ponack

[57] ABSTRACT

A structure providing a polygonal visual control room for an airport is enclosed along at least a major portion of its periphery by transparent panels, the roof of the room being supported by mullions disposed only in a minor portion or the remaining minor portion of the periphery of the room. The upper ends of the transparent panels are mounted for sealed vertical sliding movement relative to the roof.

15 Claims, 3 Drawing Sheets

STRUCTURES

BACKGROUND OF THE INVENTION

This invention relates to structures and has a particularly useful application in buildings such as airport visual control rooms where an angle of at least 180° of uninterrupted vision is desirable. To minimize visual distortion effects in airport visual control rooms, flat glass panels are employed which are inclined downward at an angle of 15° to the vertical, and the control rooms may be of pentagonal, hexagonal, octagonal or other polygonal form. The glass panels are mounted in similarly inclined mullions which conventionally support also the roof of the control room. The mullions are therefore necessarily of strong construction and interrupt the field of view to a small but not negligible extent.

SUMMARY OF THE INVENTION

According to the present invention there is disclosed a structure providing a polygonal visual control room enclosed along at least a major portion of its periphery by planar transparent panels and having a roof a major part of the area of which is supported in cantilever fashion from the upper ends of mullions disposed at the periphery of only a minor portion or the remaining minor portion of the periphery of the room.

In a preferred embodiment of the invention, the room is octagonal and the mullions are disposed at four neighboring corners of the room, the mullions at the outermost two of the four corners having their upper ends interconnected by a first structural element, and further structural elements extending from the upper ends of the mullions at the two corners intermediate the outermost two to the first structural element and thence in cantilever fashion to at least some of the remaining four corners of the room.

Preferably, the structural elements are in the form of trusses.

According to another preferred feature of the invention, the upper end of each of the transparent panels is mounted for sealed sliding vertical movement relative to the roof of the room.

The invention also provides a mounting arrangement for the upper edge of a transparent panel which is inclined to the vertical, comprising a member providing an elongate channel correspondingly inclined and adapted to receive the upper edge of the panel and having a vertically upwardly projecting portion, and a fixed elongate support element with which said upwardly projecting portion is in sealed vertically sliding engagement.

BRIEF DESCRIPTION OF THE DRAWINGS

One embodiment of the invention will now be described with reference to the accompanying drawings in which.

DETAILED DESCRIPTION OF THE INVENTION

Figure 3A:
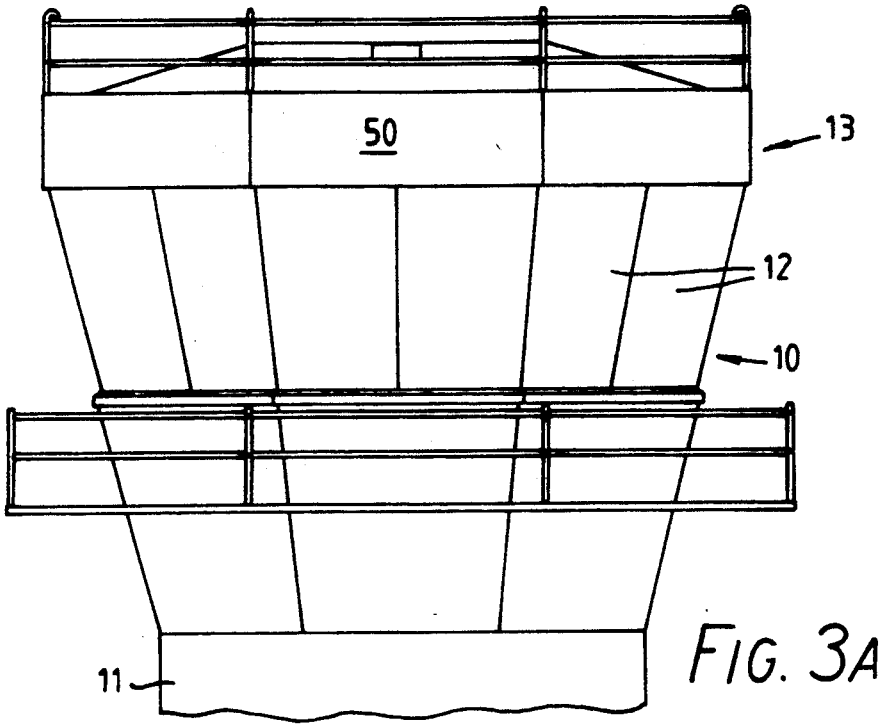
FIGS. 3A and 3B are respectively front and side elevations of the completed control room installed on a tower.
Figure 3B:
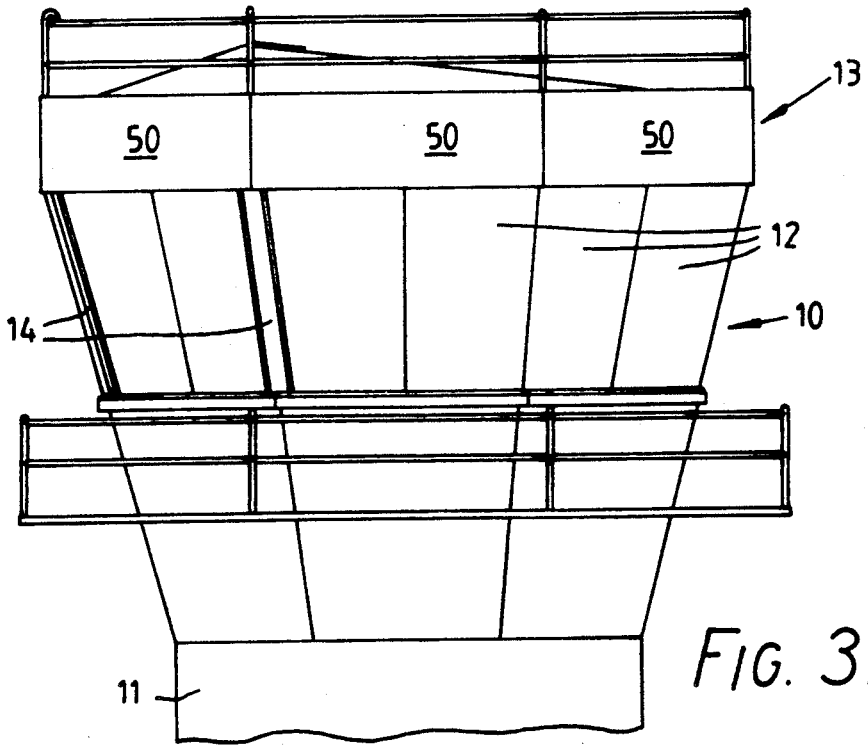

Referring to FIGS. 3A and 3B of the drawings, there is shown an airport visual control room 10 at the top of a tower 11. The room is octagonal and in the usual manner its glazing panels 12 are inclined downward at 15° to the vertical. In the illustrated room the room is glazed all around for 360° vision. The roof 13 is supported in cantilever fashion from mullions 14 at four adjacent corners of the room.

Figure 1:
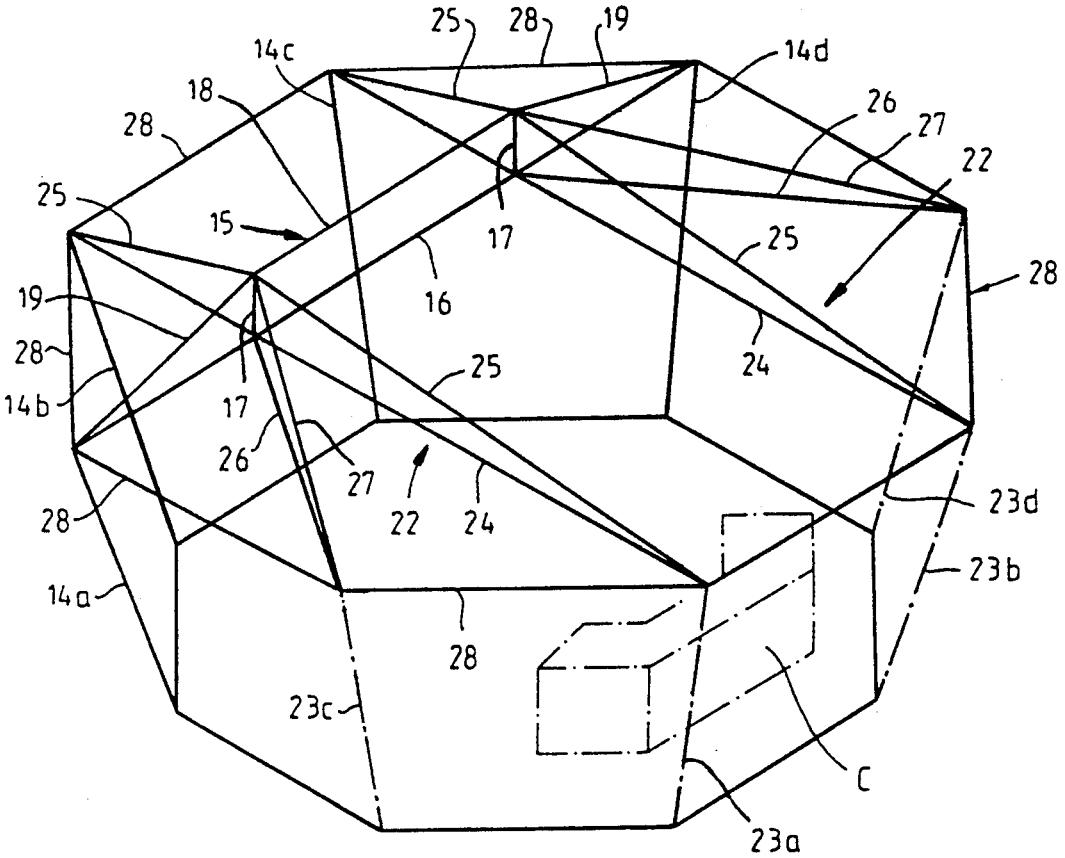
FIG. 1 shows diagrammatically, in perspective from above, the structure of an airport visual control room incorporating the invention.

Referring now to FIG. 1 of the drawings, there is shown diagrammatically the skeleton of the structure by which the roof 13 is supported. As shown, mullions **14*a*, 14*b*, 14*c*, 14*d* are disposed at four neighboring corners of the room. The two outermost mullions 14*a*, 14*d* are interconnected at their upper ends by an upright planar truss 15 comprising a main horizontal member 16, spaced struts 17, a second horizontal member 18 interconnecting the upper ends of the struts 17, and inclined members 19 respectively extending from the upper ends of the struts 17 to opposite ends of the member 16. Two cantilever trusses 22 extend parallel to each other from the upper ends of the two inner mullions 14*b*, 14*c* to respective corners 23*a*, 23*b* of the room. Each of the trusses 22 comprises a horizontal member 24 connected intermediate its ends to the lower end of one of the struts 17 and two inclined members 25 connected to the upper ends of the associated strut and to opposite ends of the horizontal member 24. A horizontal member 26 and an inclined member 27 extend from the lower and upper ends of the two struts 17 to the remaining two corners 23*c*, 23*d* of the room. Further horizontal perimeter members 28** extend along the periphery of the room interconnecting the outer ends of the trusses.

As shown in FIGS. 3A and 3B, each of the eight sides of the room is glazed by two panels of glass 12 arranged side edge to side edge and inclined downward at 15° to the vertical, and a silicon rubber or other suitable seal is disposed between these side edges. In addition, at the corners **23*a* to 23*d* a similar seal is disposed between the sheets. The omission of mullions at these corners results in a marked improvement in the field of view due to the reduction in the size of "blind spots", because the seals are relatively narrow. The consoles or desks for control room staff are usually disposed in the area indicated at C in FIG. 1** and the control room personnel thus have a substantially uninterrupted field of view over an angle well in excess of 180°.

It will be appreciated of course that the two panels of glass 12 in each side of the room could be replaced by a single panel or even three or more panels as desired.

Figure 2:
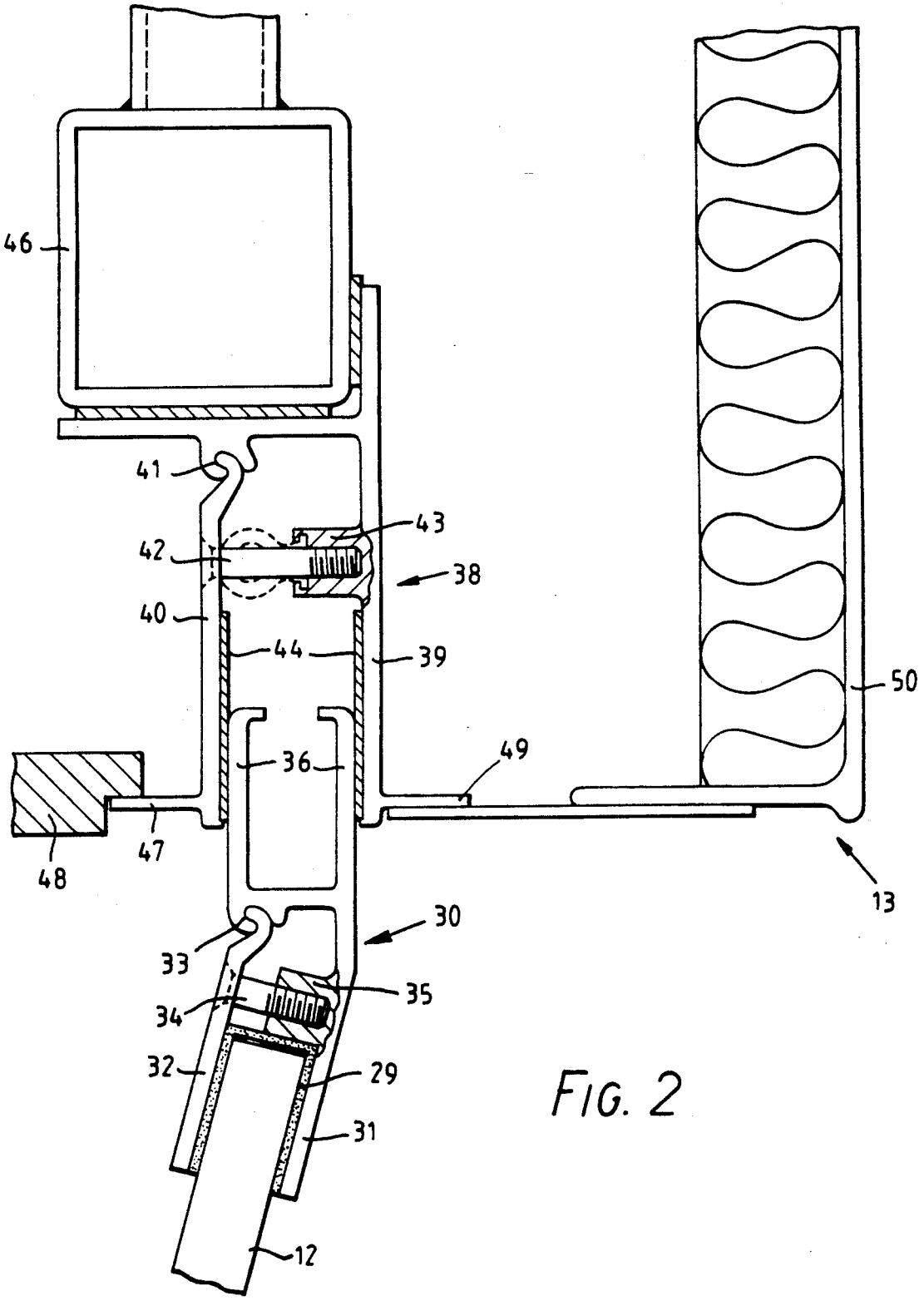
FIG. 2 shows a form of sliding sealing mounting of the transparent panels of the room in its roof.

Referring now to FIG. 2 of the drawings, a sliding sealing mounting for the upper ends of the glazing panels 12 in the roof structure 13 is shown. The top edge portion of the panel 12 is enveloped in an elastomeric or other suitable sealing material 29 and is clamped in a channel in an elongate member 30. One arm 31 of the channel is fixed, and the other arm 32 has one end pivotally engaged in a groove 33, and a setscrew 34 extends through a hole in the arm 32 and is received in a threaded socket 35 in the arm to clamp the edge of the panel adjustably and releasably. Along its upper edge the member 30 has two parallel arms 36 which are slidably engaged in a channel in a fixed upper horizontal member 38. One arm 39 of the channel is fixed and the other arm 40 has one end pivotally engaged in a groove 41, and a setscrew 42 extends through a hole in the arm 40 into a threaded socket 43 in the fixed arm enabling the width of the channel to be adjusted to provide the required degree of sealing. The inner surfaces of the arms 39, 40 have nylon bearing strips 44 secured to them to provide a smooth bearing surface for the arms 36 of member 30. The upper end of the member 38 is secured to a fixed hanger 46 attached to a horizontal member 16, 24 or 26. A ledge 47 on the outer side of the arm provides a support for ceiling tiles 48 and a similar ledge 49 on the arm is connected to the lower end of a fascia member 50 attached to a perimeter member 28.

The sliding of the arms 36 in the channel in member 38 allows the roof 13 of the room 10 to deflect to a degree as a result of external forces for example climatic forces such as wind or buildup of snow, thereby reducing any stress on the glazing panels.

It will also be appreciated that considerations such as the size of the structure may dictate that further cantilevers and other support means are provided in addition to those shown in the exemplary embodiment of FIG. 1. For example a further cantilever truss could be provided parallel to and between the trusses 22.

I claim:

1. A structure for a visual control room, comprising:

a plurality of peripheral sidewalls defining a periphery of an interior space having a polygonal shape in horizontal cross section, a corner being defined between each mutually adjacent pair of said peripheral sidewalls, each of said plurality of peripheral sidewalls comprising at least one planar panel;

a plurality of mullions mounted at a plurality of said corners, said plurality of corners at which said mullions are mounted being spaced along a continuous portion of said periphery which constitutes not more than half of said periphery of said interior space such that said periphery includes a continuous portion with mullions and a continuous portion without mullions, each mutually adjacent pair of said planar panels disposed in said portion of said periphery without mullions being mounted side edge to side edge;

a roof mounted atop said peripheral sidewalls such that said roof is supported on said mullions along said portion of said periphery with mullions, said roof extending in cantilever fashion over said portion of said periphery without mullions; and wherein at least said planar panels along said portion of said periphery without mullions are transparent panels.

2. A structure as claimed in claim 1, wherein said continuous portion of said periphery with mullions is a minor portion of said periphery; and said continuous portion of said periphery without mullions is a major portion of said periphery.

3. A structure as claimed in claim 2, wherein said polygonal shape is octagonal such that eight corners are defined about said periphery;

said mullions are disposed at four consecutive ones of said eight corners so as to define two end mullions and two mullions intermediate said end mullions; and said roof includes a first structural element extending between said two end mullions, and further structural elements extending from said intermediate mullions to said first structural element and beyond said first structural member in cantilever fashion to at least some of said corners along said continuous portion of said periphery without mullions.

4. A structure as claimed in claim 3, wherein each of said first structural element and said further structural elements comprises a truss.

5. A structure as claimed in claim 2, wherein each of said planar panels is mounted at an incline to the vertical so as to face outwardly and downwardly relative to said interior space.

6. A structure as claimed in claim 5, further comprising a lower horizontal element having a downwardly opening channel portion which embraces an upper edge of each planar panel, and an upwardly projecting portion projecting upwardly from said downwardly opening channel portion; and an upper horizontal element fixed to said roof and having a downwardly opening channel which slidingly and sealingly engages said upwardly projecting portion of said lower horizontal element.

7. A structure as claimed in claim 1, wherein at least one of said transparent panels is inclined so as to face downwardly and outwardly relative to said interior space; and each of said transparent panels has an upper edge thereof mounted for sealed sliding vertical movement relative to said roof.

8. A structure as claimed in claim 7, further comprising a plurality of first horizontally elongate members having therein a channel in which said upper ends of said transparent panels are respectively sealingly engaged, said roof including complementary elongate elements with which said first elongate members are in vertically sliding sealing engagement, respectively.

9. A structure as claimed in claim 8, wherein each of said first elongate members comprises a fixed first portion and a second portion which is pivotally connected to said first portion, said channel being formed between said first and second portions, and screw means for adjustably moving said second portion toward said first portion to adjustably clamp a respective one of said upper ends of said transparent panels in said channel.

10. A structure as claimed in claim 8, wherein each of said first elongate members has a vertically upwardly projecting portion;

each of said elongate elements has a complementary channel having sealing surfaces between which said vertically projecting portion is slidably received, said complementary channel being formed between a fixed first portion of said elongate element and a second portion of said elongate element which is pivotably connected to said fixed portion of said elongate element; and a screw means for adjustably moving said second portion of said elongate element toward said fixed first portion of said elongate element to adjust the tightness of the sliding sealing engagement of said projecting portion in said complementary channel of said elongate element.

11. A building comprising:

a tower; and a structure for a visual control room, said structure comprising:

a plurality of peripheral sidewalls defining a periphery of an interior space having a polygonal shape in horizontal cross section, a corner being defined between each mutually adjacent pair of said peripheral sidewalls, each of said plurality of peripheral sidewalls comprising at least one planar panel;

a plurality of mullions mounted at a plurality of said corners, said plurality of corners at which said mullions are mounted being spaced along a minor portion of said periphery of said interior space such that said periphery includes a minor portion with mullions and a major portion without mullions, each mutually adjacent pair of said planar panels disposed in said minor portion of said periphery being mounted side edge to side edge;

a roof mounted atop said peripheral sidewalls such that said roof is supported on said mullions along said minor portion of said periphery, said roof extending in cantilever fashion over said major portion of said periphery; and wherein at least said planar panels along said minor portion of said periphery are transparent panels.

12. A mounting arrangement for mounting an upper edge of a planar panel which is inclined to the vertical, said mounting arrangement comprising:

a member having a first elongate channel adapted to be inclined to correspond with an inclination of the planar panel and adapted to receive the upper edge of the planar panel, and a vertically upwardly projecting portion; and a fixed elongate support element sealingly and slidingly engaged with said vertically upwardly projecting portion of said member.

13. A mounting arrangement as claimed in claim 12, wherein said member comprises a first fixed arm fixed relative to said vertically upwardly projecting portion, a first pivotable arm pivotably mounted to said first fixed arm, and a first means for adjusting a distance between said first fixed arm and said first pivotable arm; and said elongate channel is defined between said first fixed arm and said first pivotable arm.

14. A mounting arrangement as claimed in claim 13, wherein said fixed elongate support element comprises a second fixed arm, a second pivotable arm pivotably mounted to said second fixed arm, and a second means for adjusting a distance between said second fixed arm and said second pivotable arm; and a second elongate channel is defined between said second fixed arm and said second pivotable arm, said vertically upwardly projecting portion of said member being sealingly and slidingly engaged in said second, elongate channel.

15. A mounting arrangement as claimed in claim 14, wherein a nylon bearing strip is fixed to each of said second fixed arm and said second pivotable arm in said second elongate channel.

* * * * *